US006071182A

United States Patent [19]

Sunagawa

[11] Patent Number: 6,071,182

[45] Date of Patent: Jun. 6, 2000

[54] GRINDSTONE AND METHOD OF MANUFACTURING THE SAME

[75] Inventor: Katsuji Sunagawa, Kyoto, Japan

[73] Assignee: Sanwa Kenma Kogyo Co., Ltd., Kyoto, Japan

[21] Appl. No.: 08/957,929

[22] Filed: Oct. 27, 1997

[30] Foreign Application Priority Data

Jan. 23, 1997 [JP] Japan ..... 9-010416

[51] Int. Cl.[7] ..... B24B 21/00

[52] U.S. Cl. ..... 451/296; 451/527; 451/530; 451/539; 451/526

[58] Field of Search ..... 451/527, 530, 451/539, 526

[56] References Cited

U.S. PATENT DOCUMENTS

| | | | |
|---|---|---|---|
| 4,010,583 | 3/1977 | Highberg . | |
| 4,618,349 | 10/1986 | Hashimoto et al. | 451/527 |
| 5,247,765 | 9/1993 | Quintana . | |
| 5,654,078 | 8/1997 | Ferronato | 451/527 |
| 5,782,682 | 7/1998 | Han et al. | 451/527 |

FOREIGN PATENT DOCUMENTS 2043501 10/1980 United Kingdom .

*Primary Examiner*—David A. Scherbel
*Assistant Examiner*—Shantese McDonald
*Attorney, Agent, or Firm*—Sughrue, Mion, Zinn, Macpeak & Seas, PLLC

[57] ABSTRACT

A sheet-shaped grindstone for grinding a workpiece includes a plurality of segments arranged in an appropriate pattern with sufficient spaces therebetween such that the grindstone becomes flexible. The segments are formed in a manner in which metal powder including diamond grinding grains is sintered to form granular chips, the chips are disposed in a die in such a density that the chips come into mutual contact, and gaps around the granular chips are filled with a resin through application of pressure. The grindstone is more flexible at contact points with a workpiece than are conventional vitrified grinding tools. The grindstone can evade collision of the segments with the workpiece and can grind a curved surface of the workpiece through smooth contact therewith.

4 Claims, 10 Drawing Sheets

GRINDSTONE AND METHOD OF MANUFACTURING THE SAME

BACKGROUND OF THE INVENTION

1. Field of the Invention

The present invention relates to a flexible grindstone that can be used to grind a curved surface of a workpiece such as stone speedily, as well as to a method of manufacturing such a grindstone.

2. Description of the Related Art

As a flexible coarse grinding tool having a large grain size (such as #40, #60, or #150) that is required to provide a large grinding force and to grind a large amount of material, there has been known a sheet-shaped flexible vitrified grinding tool having a plurality of grinding projections that include grinding grains. However, such a conventional grinding tool is poor in terms of making contact with a curved surface of a workpiece (such as stone), and involves difficulty in forming a smooth curved surface.

FIGS. 13 and 14 show a flexible vitrified diamond grinding tool invented by the inventors of the present invention (Japanese Utility Model Publication (kokoku) No. 4-5252). In FIG. 13, numeral 1 denotes cylindrical grinding chips, which are formed by disposing vitrified mixed powder containing grinding grains of diamond or cubic crystal boron nitride (CBN) in a die having a plurality of small holes arranged in line along concentric circles and then burning the powder.

Numeral 2 denotes a flexible base such as imitation leather impregnated with thermosetting resin. The grindstone portion is formed by the grinding chips 1 and the base 2.

To attach the grinding chips 1 to the base 2 in an integrated manner, the base 2 is impregnated with the thermosetting resin and then the grinding chips 1 are placed on the top thereof. Subsequently, the grinding chips 1 and the base 2 are heated, so that the thermosetting resin hardens while the grinding chips 1 and the base 2 combine into an integrated unit.

After the grinder portion is formed, a surface fastener 3 is attached to the back surface of the base 2 which has been hardened with flexibility. When grinding is performed, the surface fastener 3 is attached to a fastener of the attachment fixed to the output shaft of an electrically-driven or air-driven tool.

SUMMARY OF THE INVENTION

An object of the present invention is to provide a grindstone for grinding a workpiece such as stone, which is more flexible at contact points with the workpiece than are conventional vitrified grinding tools, and which can evade collision of the segments with the workpiece and can grind a curved surface of the workpiece through smooth contact therewith.

According to a first aspect of the present invention, there is provided a sheet-shaped grindstone for grinding a workpiece, the grindstone characterized by comprising a plurality of segments arranged in an appropriate pattern with sufficient spaces therebetween such that the grindstone becomes flexible. The segments are formed as follows: metal powder including diamond grinding grains is sintered to form pellet chips; the chips are disposed in a die; and gaps around the pellet chips are filled with a resin through application of pressure.

According to a second aspect of the present invention, there is provided a sheet-shaped grindstone for grinding a workpiece, characterized by comprising a plurality of segments arranged in an appropriate pattern with sufficient spaces therebetween such that the grindstone becomes flexible. The segments are formed as follows: metal powder including diamond grinding grains is sintered to form granular chips; the chips are disposed in a die in such a density that the chips come into mutual contact; and gaps around the granular chips are filled with a resin through application of pressure.

According to a third aspect of the present invention, there is provided a method for manufacturing a grindstone for grinding a workpiece, characterized in that metal powder including diamond grinding grains is sintered to form granular chips; the chips are disposed in a die in such a density that the chips come into mutual contact; and gaps around the granular chips are filled with a resin through application of pressure, so that the grindstone is formed in a desired shape.

According to a fourth aspect of the present invention, there is provided a sheet-shaped grindstone for grinding a workpiece, characterized by comprising a plurality of segments arranged in an appropriate pattern with sufficient spaces therebetween such that the grindstone becomes flexible. The segments are formed as follows: vitrified bond containing diamond grinding grains is burned to form granular chips; the chips are disposed in a die in such a density that the chips come into mutual contact; and gaps around the granular chips are filled with a resin through application of pressure.

According to a fifth aspect of the present invention, there is provided a method for manufacturing the grindstone for grinding a workpiece, characterized in that vitrified bond containing diamond grinding grains is burned to form granular chips; the chips are disposed in a die in such a density that the chips come into mutual contact; gaps around the granular chips are filled with a resin through application of pressure, so that the grindstone is formed in a desired shape.

Preferably, each of the above-described grindstones has a surface fastener bonded onto the back surface of the grindstone.

Preferably, each of the above-described methods comprises a step of bonding a surface fastener onto the back surface of the grindstone.

In the sheet-shaped grindstone according to the present invention, a plurality of segments are arranged in an appropriate pattern with sufficient spaces therebetween so that the grindstone becomes flexible, and each of the segments is formed such a way that metal powder including diamond grinding grains is sintered to form pellet chips, the chips are disposed in a die, and gaps around the pellet chips are filled with a resin through application of pressure. Therefore, it becomes possible to easily manufacture a superior metal bond grindstone of a complicated shape, which has the elasticity of resin and the cutting ability of the pellet chips.

In the grindstone of the present invention, each segment is manufactured in such a way that metal powder (or vitrified bond) containing diamond grinding grains is sintered (or burned) to form granular chips, the chips are disposed in a die, and gaps around the granular chips are filled with a resin through application of pressure. The grindstone can be made more flexible compared to the grindstone in which metal pellet chips are buried in a resinoid base, and grinding of a workpiece having a curved surface becomes easier. Moreover, the periphery of the grindstone also can be used for grinding.

DESCRIPTION OF THE PREFERRED EMBODIMENTS

Figure 1:
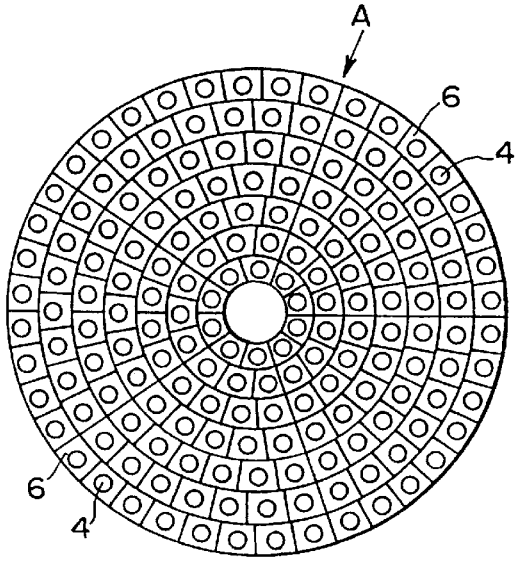
FIG. 1 is a plane view of a grindstone according to an embodiment of the present invention.
Figure 2:
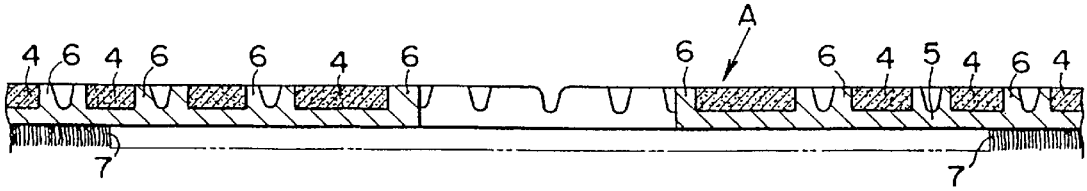
FIG. 2 is an enlarged cross sectional view of FIG. 1.

Embodiments of the present invention will next be described with reference to the drawings. FIG. 1 is a plane view of a grindstone A according to an embodiment of the present invention, and FIG. 2 is a cross sectional view thereof. Numeral 4 denotes pellet chips which are made from metal powder including diamond grinding grains through a sintering process. Numeral 5 denotes a sheet-shaped resinoid base, on which a plurality of segments are arranged in line along concentric circles with sufficient spaces therebetween for securing flexibility. Each segment 6 contains a single pellet chip 4 described above. Numeral 7 denotes a surface fastener which is bonded to the back surface of the resinoid base 5.

Figure 3:
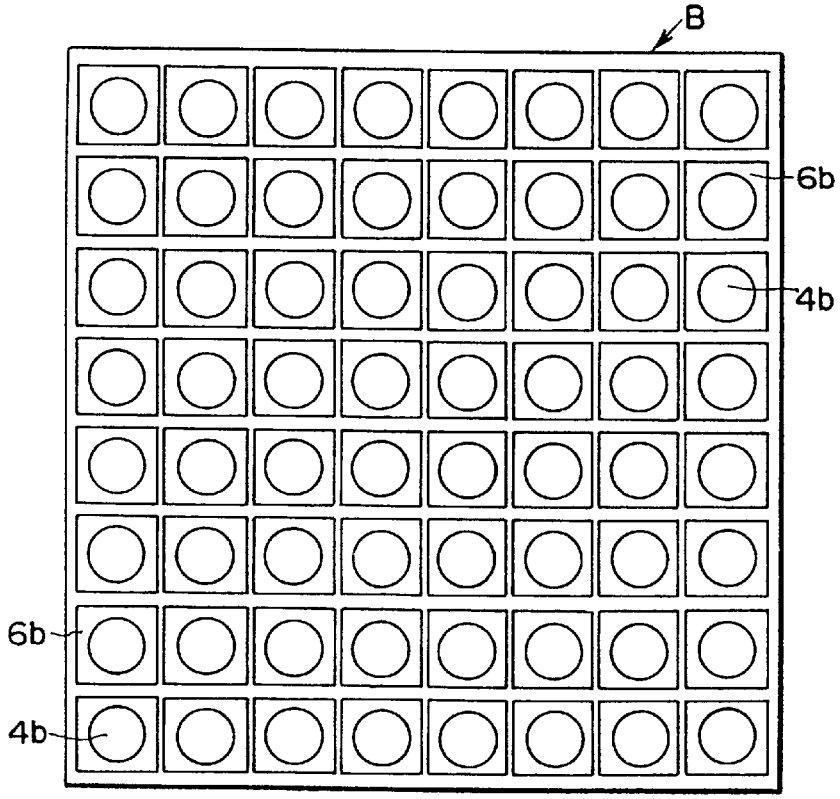
FIG. 3 is a plane view of a grindstone according to another embodiment of the present invention.

FIG. 3 is a plane view of a grindstone B according to another embodiment of the present invention, wherein the segments 6*b* are arranged in a rectangular grid. Each segment 6*b* contains a single pellet chip 4*b*.

Figure 4:
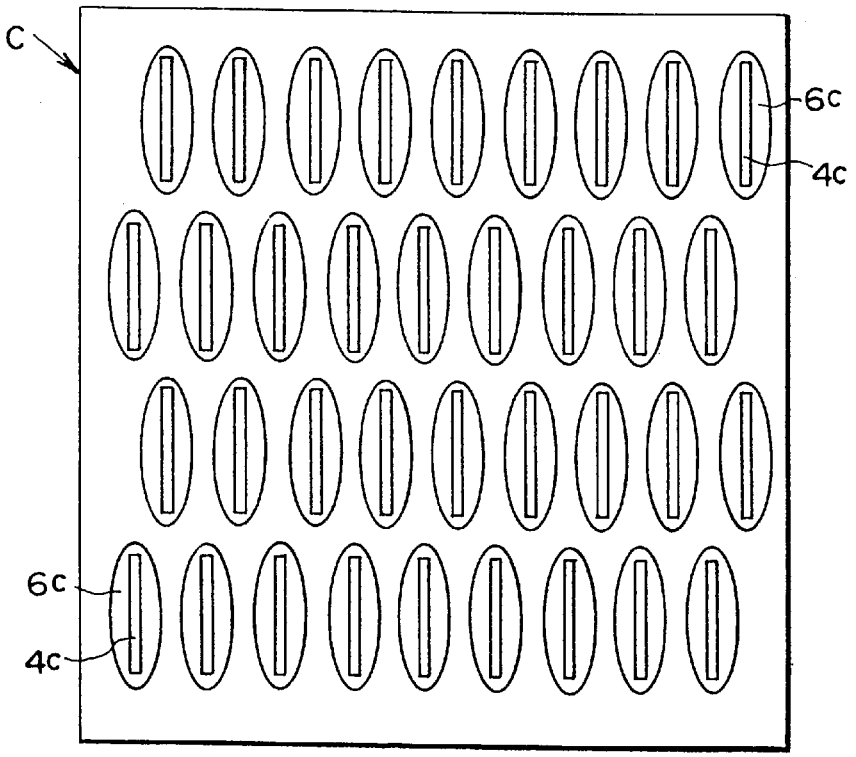
FIG. 4 is a plane view of a grindstone according to yet another embodiment of the present invention.

FIG. 4 is a plane view of a grindstone C according to yet another embodiment of the present invention, wherein a plurality of elongated segments 6*c* are arranged. Each of the segments 6*c* contains a single pellet chip 4*b* of a needle shape.

Figure 5:
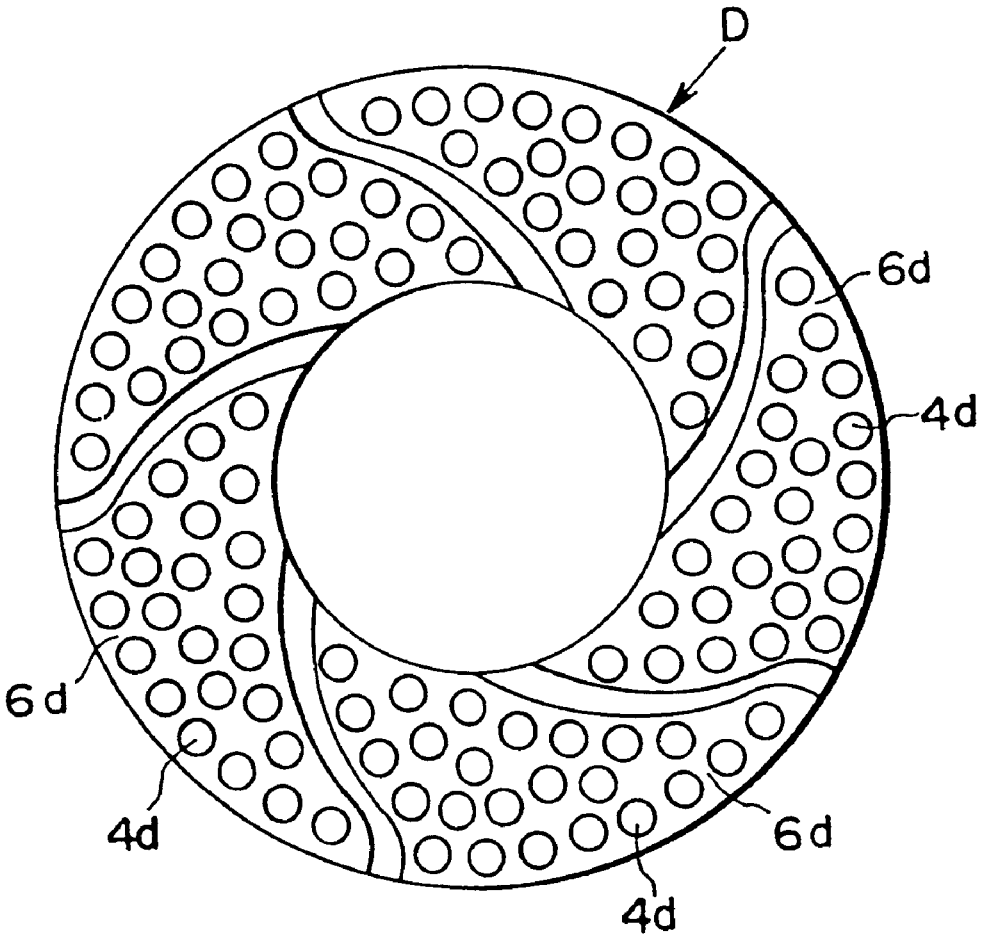
FIG. 5 is a plane view of a grindstone according to yet another embodiment of the present invention.

FIG. 5 is a plane view of a grindstone D according to yet another embodiment of the present invention, wherein five segments 6*d* are arranged symmetrically with respect to a single point. Each of the segments 6*d* has a plurality of pellet chips 4*d* in it.

Figure 6A:
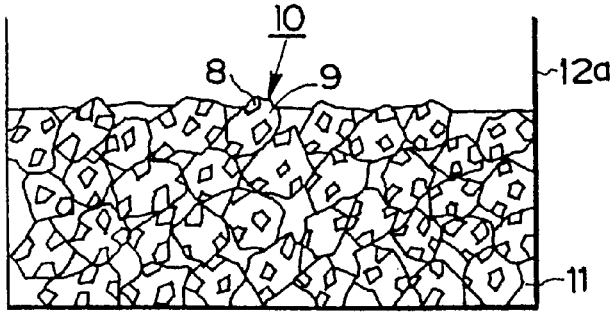
FIG. 6A is a cross sectional view for explaining a method of manufacturing a segment through use of metal grains.

A method of manufacturing segments through use of metal granular chips will now be described. In FIG. 6A, numeral 10 denotes a granular chip which is formed from metal powder 9 including diamond grinding grains 8 through a sintering process. The granular chips 10 are disposed in segment-forming sections 12*a* of a die in such a density that the granular chips 10 come into contact with each other. Then the gaps between the granular chips 10 are filled with resin 11 through the application of pressure. The granular chips which are formed from metal powder including diamond grinding grains through sintering are most preferable for the above-described segment manufacturing method. In a next most preferable case, vitrified bond including diamond grinding grains is burned to form granular chips, which are then disposed in the segment-forming sections in such a density that the granular chips come into mutual contact.

Figure 6B:
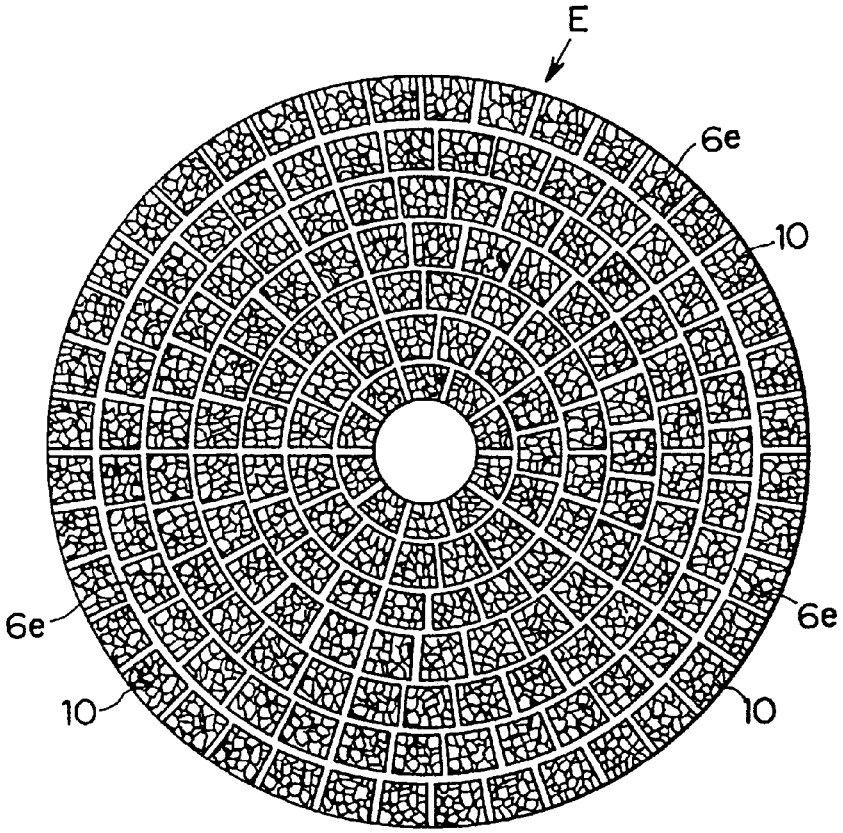
FIG. 6B is a plane view of a grindstone having granular chips.

As shown in FIG. 6B, a plurality of segments 6*e* are arranged in line along a plurality of concentric circles with sufficient gaps therebetween for securing flexibility. Thus, a sheet-shaped grindstone E is manufactured. The shape and arrangement of the segments are not limited to those described above, provided that a plurality of the segments are arranged in a desired pattern to form a thin sheet-shaped grindstone.

Figure 7:
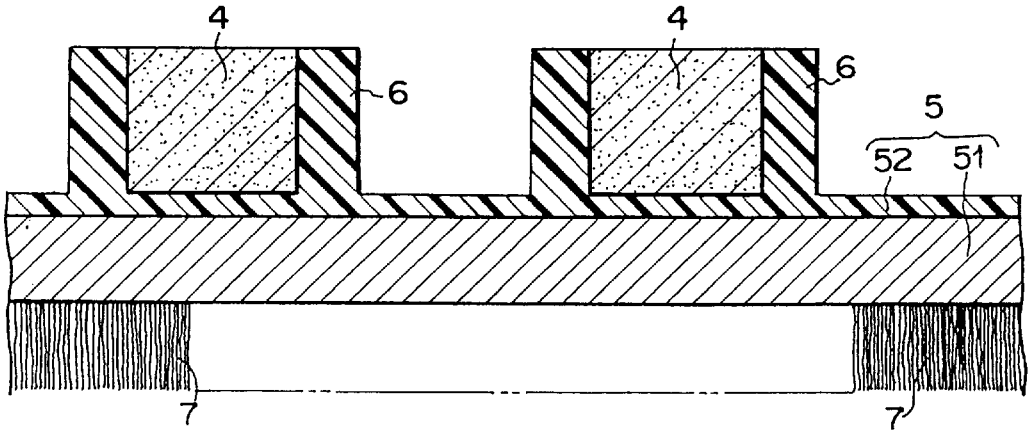
FIG. 7 is an enlarged partial cross section of a grindstone of the present invention.
Figure 8:
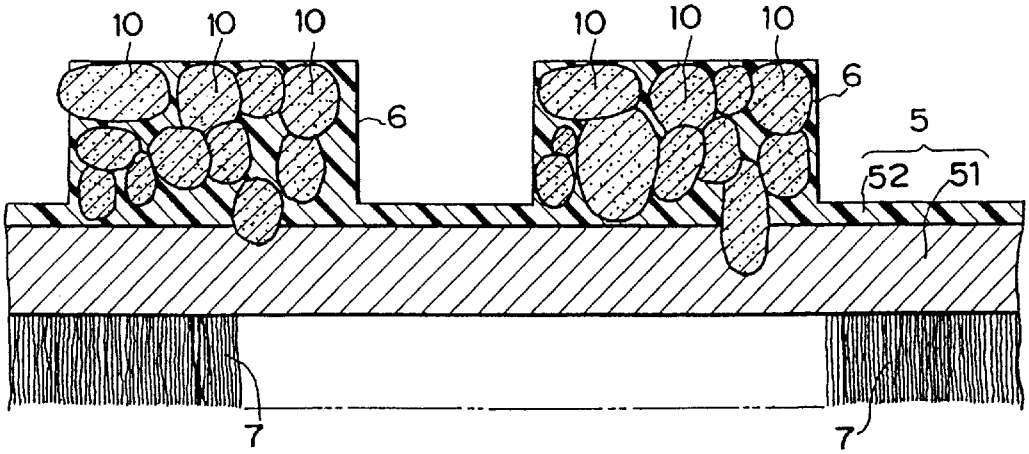
FIG. 8 is an enlarged partial cross section of a grindstone of the present invention.

FIGS. 7 and 8 are enlarged partial cross sections of a grindstone according to the present invention. FIG. 7 shows a grindstone with each of the segments 6 having a pellet chip 4, and FIG. 8 shows a grindstone with each of the segments 6 having a plurality of granular chips 10. The resinoid base 5 comprises a base portion 51 and a resin portion 52. The base portion 51 may be made of a flexible material such as unwoven cloth, and the resin portion 52 may be formed from, for example, liquid resin, resin paste, resin sheet, or resin powder. A method of manufacturing the grindstone will now be described for each of the different resin to be used.

(A) A method in which the base portion (unwoven cloth) is impregnated with a resin in advance (see FIGS. 9A–9C):

This method is applicable when liquid resin or resin paste is used.

Figure 9A:
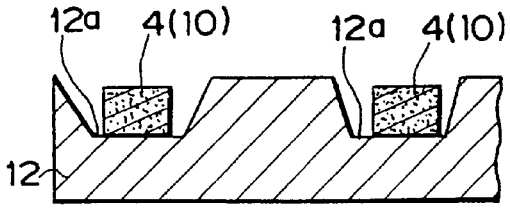
FIGS. 9A–9C show a method in which a base portion (unwoven cloth) is impregnated with a resin in advance.

(1) First, a pellet chip 4 or a granular chip 10 (hereinafter referred to simply as a "chip") is disposed in each segment-forming section 12*a* of a die 12 (see FIG. 9A).

(2) The base portion 51 is impregnated with a resin.

Figure 9B:
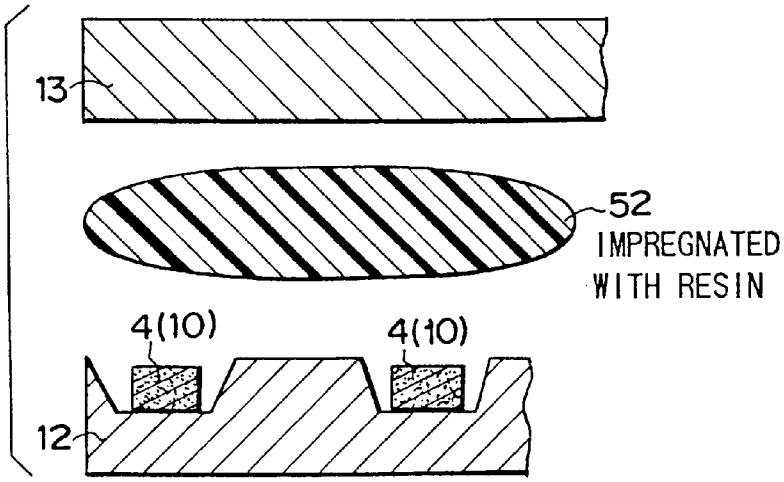
Figure 9C:
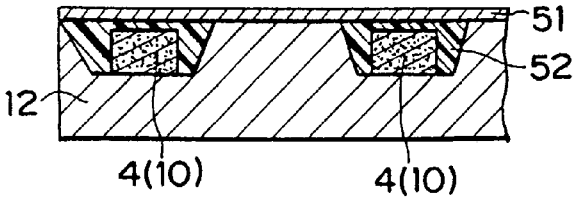

(3) The base portion 51 impregnated with the resin is placed on the die 12, an upper die 13 is closed, and heat and pressure are applied (see FIG. 9B).

(4) When the hardening of the resin portion 52 is completed, the pressure is relieved (see FIG. 9C), and the grindstone formed in a required sheet-like shape is removed from the die 12. A surface fastener is then bonded to the bottom surface of the sheet-shaped grindstone.

In Step (3) of the method described above, resin portion 52 present within the base portion 51 exudes out into the cavities of the die 12, thus surrounding the chips and fixing them to the base portion 51.

(B) A method in which a resin is applied or bonded onto the base portion (unwoven cloth) in advance (see FIGS. 10A–10C):

This method is applicable when resin paste or resin sheet is used.

Figure 10A:
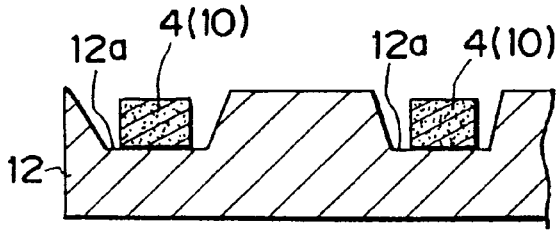
FIGS. 10A–10C show a method in which a resin is spread or bonded onto a base portion (unwoven cloth) in advance.

(1) First, a chip 4 (10) is disposed in each segment-forming section 12*a* of a die 12 (see FIG. 10A).

(2) The resin is spread or bonded onto the bottom surface of the base portion 51.

Figure 10B:
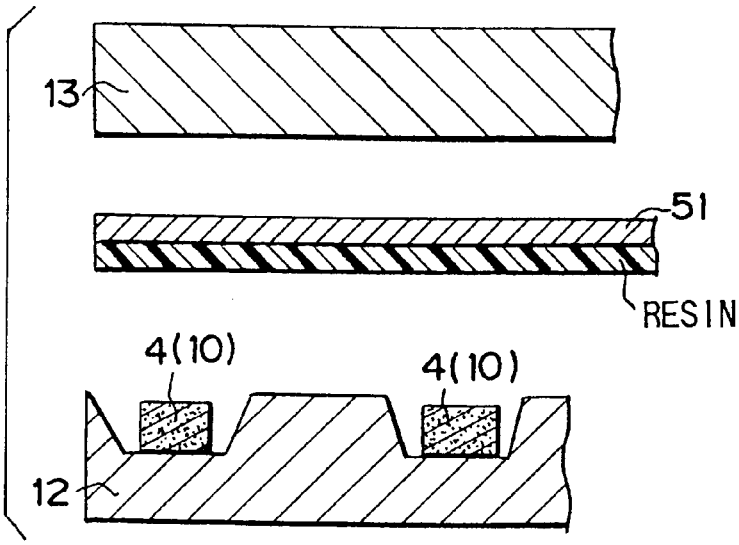
Figure 10C:
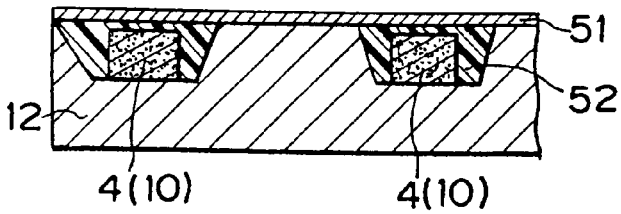

(3) The base portion 51 onto which the resin has been spread or bonded is placed on the die 12, the upper die 13 is closed, and heat and pressure are applied (see FIG. 10B).

(4) When the hardening of the resin portion 52 is completed, the pressure is relieved (see FIG. 10C), and the grindstone formed in a required sheet-like shape is removed from the die 12. Subsequently, a surface fastener is bonded to the bottom surface of the sheet-shaped grindstone.

In Step (3) of the method described above, the resin portion 52 which existed on the surface of the base portion 51 fills the die 12, thereby surrounding the chips 4 (10) and fixing them to the base portion 51. The main difference from the method (A) is that the resin exists essentially on the surface of the base portion 51 in Step (2), although some of the resin may have been osmosed into the base portion 51. The base portion 51 is not necessarily required to be made of a material into which the resin can osmose, but it can be made of a material into which the resin cannot osmose, such as a heat resistant resin sheet.

(C) A method in which a resin is added directly to the segment-forming sections of the die into which chips have been placed (see FIGS. 11A–11C and FIGS. 12A–12C):

This method is applicable when liquid resin, resin sheet, or resin powder is used.

Figure 11A:
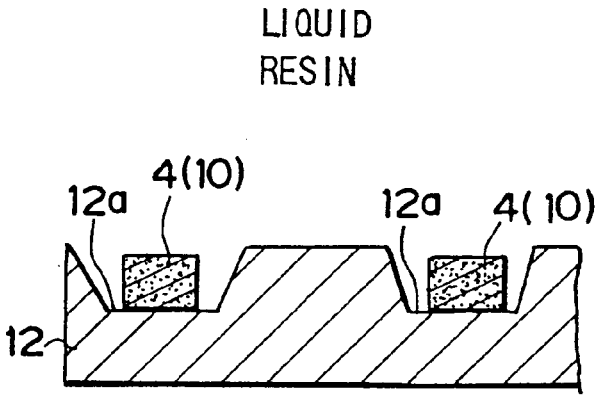
FIGS. 11A–11C show a method in which a resin is added directly to segment-forming sections of a die into which chips have been placed (the case where liquid resin is used)
Figure 12A:
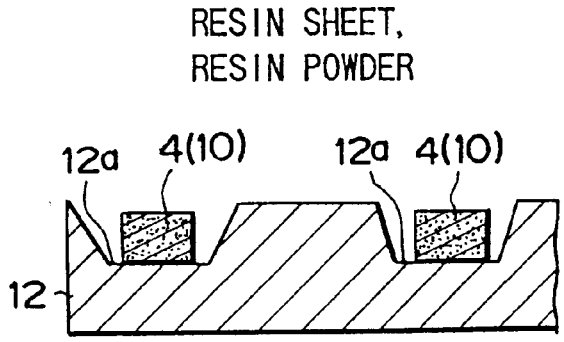
FIGS. 12A–12C show a method in which a resin is added directly to segment-forming sections of a die into which chips have been placed (the case where resin sheet or resin powder is used)
Figure 12B:
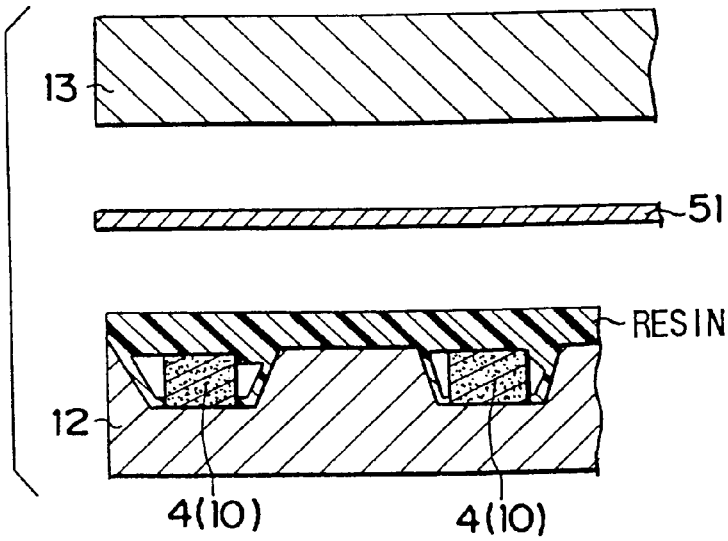
Figure 12C:
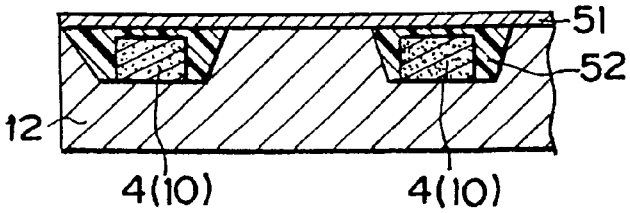
Figure 13:
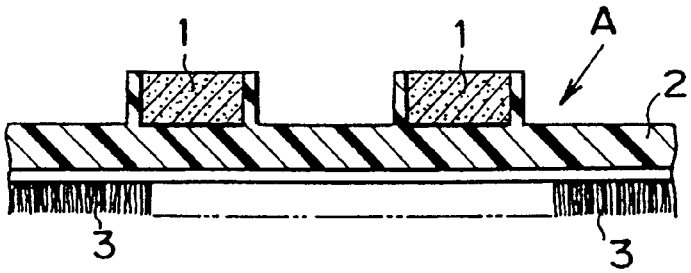
FIG.13 (PRIOR ART)
FIG. 13 is a cross sectional view of a conventional grinding tool.
Figure 14:
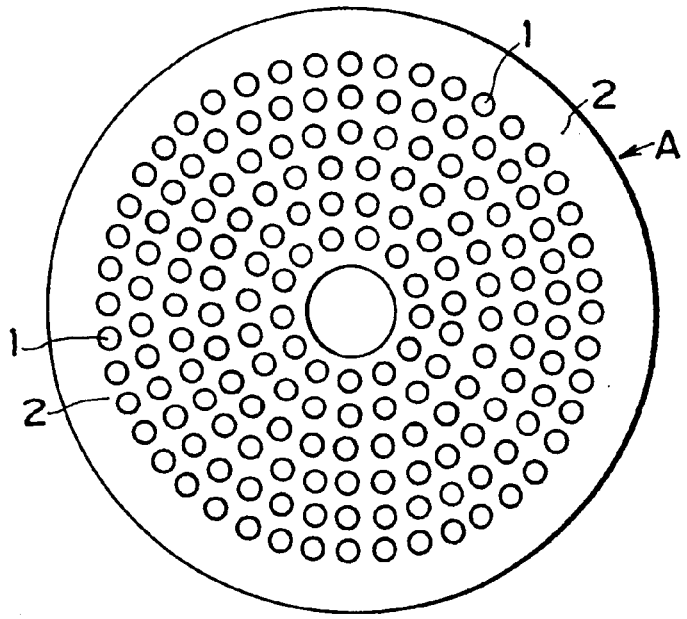
FIG.14 (PRIOR ART)
FIG. 14 is a plane view of the conventional grinding tool.

(1) First, a chip 4 (10) is disposed in each segment-forming section 12*a* of a die 12 (see FIGS. 11A or 12A).

Figure 11B:
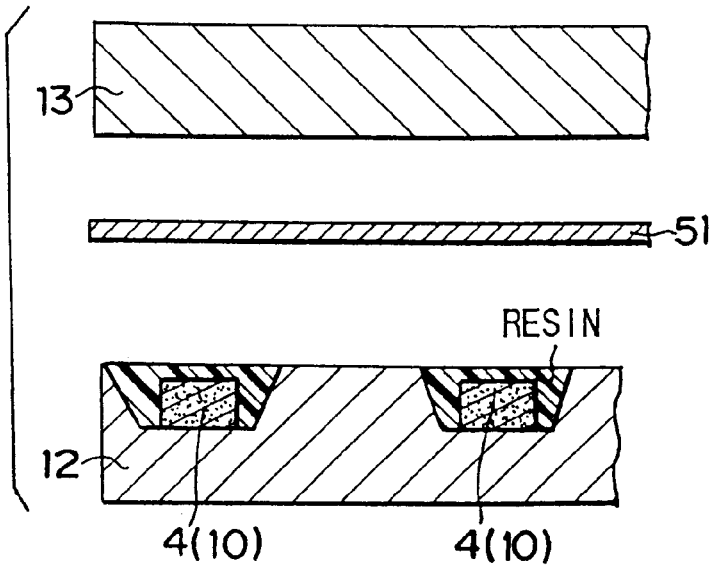
Figure 11C:
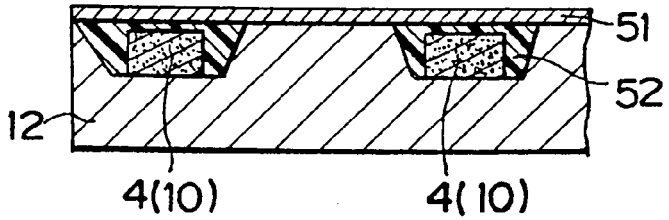

(2) If the resin is in liquid form, the resin is poured in the segment-forming section 12*a* and the gap between the die and the chip is filled with the resin (see FIG. 11B). If the resin is in sheet or powder form, it is placed on the die 12 (see FIG. 12B).

(3) The base portion 51 is placed on the die 12, and the upper die 13 is closed, and then heat and pressure are applied.

(4) When the hardening of the resin is completed (see FIGS. 11C and 12C), the pressure is relieved, and the grindstone formed in a required sheet-like shape is removed from the die 12. Subsequently, a surface fastener is bonded to the bottom surface of the sheet-shaped grindstone.

In Step (3) of the method described above, if the resin is in liquid form, the resin which filled and existed in the die 12 surrounds the chips and fixes them to the base portion 51, whereas if the resin is in sheet or powder form, the resin surrounds the chips from above and fixes them to the base portion 51. The main difference from the methods (A) and (B) is that the resin is placed not on the base portion 51 but on the die 12 which is already filled with the chips in Step (2). In this method, the base portion 51 is not necessarily required to be made of a material into which the resin can osmose, but it can be made of a material into which the resin cannot osmose, such as a heat resistant resin sheet.

What is claimed is:

1. A method for manufacturing a grindstone for grinding a workpiece, comprising the steps of:

sintering in advance a metal powder including diamond grinding grains to form granular chips;

disposing the granular chips in each of a plurality of segment-forming sections of a die in such a density that the chips come into mutual contact; and filling gaps around the granular chips with a resin through application of pressure, thereby forming a grindstone having a desired shape.

2. A method for manufacturing a grindstone according to claim 1, further comprising a step of bonding a surface fastener onto the back surface of the formed grindstone.

3. A method for manufacturing a grindstone for grinding a workpiece, comprising the steps of:

burning in advance vitrified bond containing diamond grinding grains to form granular chips;

disposing the granular chips in each segment-forming section of a die in such a density that the chips come into mutual contact; and filling gaps around the granular chips with a resin through application of pressure, thereby forming a grindstone having a desired shape.

4. A method for manufacturing a grindstone according to claim 3, further comprising a step of bonding a surface fastener onto the back surface of the formed grindstone.

* * * * *